US009629765B1

(12) United States Patent
Mitchell

(10) Patent No.: US 9,629,765 B1
(45) Date of Patent: Apr. 25, 2017

(54) RESCUE CHAIR

(71) Applicant: Thomas Mitchell, Salem, AL (US)

(72) Inventor: Thomas Mitchell, Salem, AL (US)

( * ) Notice: Subject to any disclaimer, the term of this patent is extended or adjusted under 35 U.S.C. 154(b) by 0 days.

(21) Appl. No.: 15/072,666

(22) Filed: Mar. 17, 2016

(51) Int. Cl.

| | |
|---|---|
| ***A61G 5/14*** | (2006.01) |
| ***A61G 1/003*** | (2006.01) |
| ***A61G 1/017*** | (2006.01) |
| ***A61G 1/013*** | (2006.01) |
| ***A61G 1/04*** | (2006.01) |
| ***A61G 5/08*** | (2006.01) |
| ***A61G 5/10*** | (2006.01) |
| ***A61G 5/12*** | (2006.01) |

(52) U.S. Cl.
CPC ..... *A61G 5/14* (2013.01); *A61G 1/003* (2013.01); *A61G 1/013* (2013.01); *A61G 1/017* (2013.01); *A61G 1/04* (2013.01); *A61G 5/08* (2013.01); *A61G 5/1067* (2013.01); *A61G 5/1075* (2013.01); *A61G 5/12* (2013.01); *A61G 2005/125* (2013.01)

(58) Field of Classification Search
CPC . A61G 5/14; A61G 5/12; A61G 1/017; A61G 1/003; A61G 5/08; A61G 5/1075; A61G 5/1067; A61G 1/013; A61G 1/04; A61G 2005/125; A61G 7/1021; A47C 13/00
USPC ..... 297/DIG. 8, DIG. 10, 118; 5/615
See application file for complete search history.

(56) References Cited

U.S. PATENT DOCUMENTS

| | | | | |
|---|---|---|---|---|
| 3,420,574 | A * | 1/1969 | Smith | A47C 4/54 297/232 |
| 4,005,498 | A | 2/1977 | Starr | |
| 4,127,906 | A * | 12/1978 | Zur | A61G 7/015 297/DIG. 10 |
| 4,153,958 | A * | 5/1979 | Paulik | A47C 4/52 297/118 |
| 4,188,677 | A * | 2/1980 | Zur | A47C 20/048 5/412 |
| 4,287,620 | A * | 9/1981 | Zur | A61G 7/015 297/10 |
| 4,977,629 | A | 12/1990 | Jones | |
| 5,020,168 | A | 6/1991 | Wood | |
| 5,988,747 | A | 11/1999 | Jeans | |
| 6,651,280 | B2 | 11/2003 | Blevins | |
| 6,857,144 | B1 | 2/2005 | Huang | |
| 7,444,693 | B2 | 11/2008 | Russo | |
| 8,578,560 | B1 * | 11/2013 | Swinehart | A61G 5/10 16/324 |

(Continued)

*Primary Examiner* — Robert G Santos
*Assistant Examiner* — Myles Throop
(74) *Attorney, Agent, or Firm* — Bradley Arant Boult Cummings LLP; Nicholas J. Landau; Michael C. Williams

(57) ABSTRACT

The present invention is portable lifting apparatus for raising a supine bipedal user into a sitting position with the assistance of sequentially inflated bodies. This device includes a sectional cot, a plurality of inflatable bodies, and a rigid, foldable, locking frame. The addition of the frame, as opposed to the sole use of the inflatable bodies, provides additional stability for the apparatus during the rescue process. Further, due to the rigidity of the frame, it allows another person to lift and carry the apparatus with the patient on it. The apparatus may also include collapsible armrest for use by the patient. The inflatable bodies may inflate simultaneously, resulting in a rapidly raising the patient to a sitting position.

19 Claims, 4 Drawing Sheets

(56) References Cited

U.S. PATENT DOCUMENTS

| | | | | |
|---|---|---|---|---|
| 2002/0101103 | A1* | 8/2002 | Johnston | A61G 5/14 297/330 |
| 2014/0196207 | A1* | 7/2014 | Enriquez | A61G 7/053 5/11 |

* cited by examiner

RESCUE CHAIR

BACKGROUND

A. Field of the Disclosure

The present disclosure relates generally to personal assistance devices. Such devices as well as methods for use therewith are provided.

B. Background

Falls are a major source of accidental injury worldwide. Although the fall itself can cause significant and even fatal injury due to impact, victims often suffer additional injury while trying to recover from the fall into a sitting or standing position. Difficulties and injuries resulting from attempts to stand or sit are especially common when the victim is elderly, physically disabled, or badly injured from the fall.

If a victim is unable to rise to a standing or sitting position, then they are helpless to obtain food, obtain water, take any needed medications, sit on the toilet, or move to a telephone to call for help. In some cases the fall victim may be bleeding, and unable to reach medical supplies to stanch the wound (this is especially true of older victims who are more likely to be taking prescription blood thinners). Fall victims sometimes die of thirst or blood loss for this reason, even if they are not badly hurt by the fall.

In addition, in attempting to stand or sit the victim may injure herself further. For example, a victim attempting to rise to a standing position might fall again. The exertion can cause muscle injuries in the victim's arms, shoulder, or back.

Even when another person is available to help, raising a fallen person can be risky. Human beings are of course heavy, and it can be difficult to properly balance while attempting to draft or lift a person. That can cause injury to the person assisting the victim, who may fall or sustain a muscle injury due to the heavy and unbalanced load. Lifting a person requires a firm grip on the victim to assure that the victim is not dropped, and this can result in bruising or other injuries to the victim if the assistant is not very careful. In addition, improper lifting or dragging technique can cause joint dislocations in the victim.

Ideally there would be a way that a fall victim can easily recover from a fall without assistance, which could also facilitate the safe lifting of the victim.

Russo (U.S. Pat. No. 7,444,693), for example, attempted to address the problem with a lift device that is a flat blanket with a plurality of inflatable bladders. The victim lies on the blanket, and the bladders inflate, raising the victim's back. However, such a device is inherently unstable. Air bladders must be made of flexible material in order to be inflatable; otherwise they cannot change shape and inflate. When inflated, the flexible air bladders will inevitably shift and change shape under the victim's weight. This provides an unstable platform for a victim attempting to stand up, which could result in another fall. In addition, the flexible bladders in Russo's device would not be rigid enough to allow the victim to be carried while on the device by rescuers.

SUMMARY

The problems described above are addressed by the rescue chair described in this disclosure, although it is to be understood that not all such problems will be solved by every embodiment of the chair.

A first aspect of the invention is a portable lifting apparatus wherein a patient may be lifted from a supine position to a sitting position, comprising: a cot, a plurality of inflatable airbags, and a rigid, foldable, locking frame; the cot having a back section, seat section, lower section, and base, to be placed under the patient in the supine position; wherein the plurality of inflatable airbags are located in the following locations: underneath the back section and above the frame extending from the seat section, and between the base and the frame extending from a pivot location connecting the seat section and the lower section; and wherein the frame provides additional support for the patient.

A second aspect of the invention is an apparatus for raising a supine bipedal user into a sitting position, the apparatus capable of assuming a horizontal cot configuration and an upright chair configuration, the apparatus comprising: (a) a seatback that is substantially horizontal in the horizontal cot configuration; (b) a seat adjacent to the seatback that is substantially horizontal in the horizontal cot configuration; (c) a hassock adjacent to the seat that is substantially horizontal in the horizontal cot configuration; (d) a base adjacent to the hassock that is folded under the hassock in the horizontal cot configuration; (e) a rigid load-bearing frame that supports the seatback, the seat, the hassock, and the base, and comprising a plurality of locking joints positioned to allow the seatback, the seat, the hassock, and the base to swivel relative to one another; (f) a first inflatable body positioned to swivel the seatback at least 45° relative to the seat when at least partially inflated; and (g) a second inflatable body positioned to raise the seat to an elevation sufficient to cause the hassock to swivel about 90° relative to the seat when inflated; wherein the frame locks to arrest the swivel of the seatback relative to the seat when the seatback reaches a first locking angle relative to the seat; the frame locks to arrest the swivel of the hassock relative to the seat when the hassock reaches a second locking angle relative to the seat; and the frame locks to arrest the swivel of the base relative to the hassock when the base reaches a third locking angle relative to the hassock, A third aspect of the invention is a folding inflatable rescue chair comprising: (a) a seatback; (b) a seat; (c) two front legs; (d) a base; (e) a load-bearing frame that is jointed to allow the seatback, the seat, the two front legs, and the base to swivel relative to one another; (f) a first inflatable airbag positioned to swivel the seatback at least 45° relative to the seat when at least partially inflated; and (g) a second inflatable airbag positioned to raise the seat to an elevation sufficient to cause the two front legs to swivel about 90° relative to the seat when inflated; wherein the frame locks to arrest the swivel of the seatback relative to the seat when the seatback reaches a first angle of at least 45° relative to the seat; the frame locks to arrest the swivel of the two front legs relative to the seat when the two front legs reach a second angle of about 90° relative to the seat; and the frame locks to arrest the swivel of the base relative to the two front legs when the base reaches an angle of about 90° relative to the two front legs.

A fourth aspect of the invention is a rescue cot to raise a supine user into a sitting position without assistance, the cot comprising: (a) a load-bearing cot frame; (b) a back-supporting section; (c) a buttocks-supporting section; (d) a first frame joint positioned to allow the back-supporting section to swivel relative to the buttocks-supporting section, and configured to lock when the back-supporting section is inclined by at least a first locking angle relative to the buttocks-supporting section; (e) a leg-supporting section; (f) a second frame joint positioned to allow the leg-supporting section to swivel relative to the buttocks-supporting section, and configured to lock when the leg-supporting section is inclined by a second locking angle relative to the buttocks-supporting section; (g) a base section adjacent to and folded under the leg-supporting section; (h) a third frame joint positioned to allow the base section to swivel relative to the leg-supporting section, and configured to lock when the leg-supporting section is inclined by a third locking angle relative to the base section; (i) a first inflatable member under the back-supporting section, positioned to raise the back-supporting section by at least 45° when inflated; and (j) a second inflatable member under the buttocks-supporting section, positioned to elevate the buttocks-supporting section while maintaining it level.

The foregoing presents a simplified summary in order to provide a basic understanding of some aspects of the claimed subject matter. This summary is not an extensive overview. It is not intended to identify key or critical elements or to delineate the scope of the claimed subject matter. Its sole purpose is to present some concepts in a simplified form as a prelude to the more detailed description that is presented later.

DETAILED DESCRIPTION

A. Definitions

Figure 1:
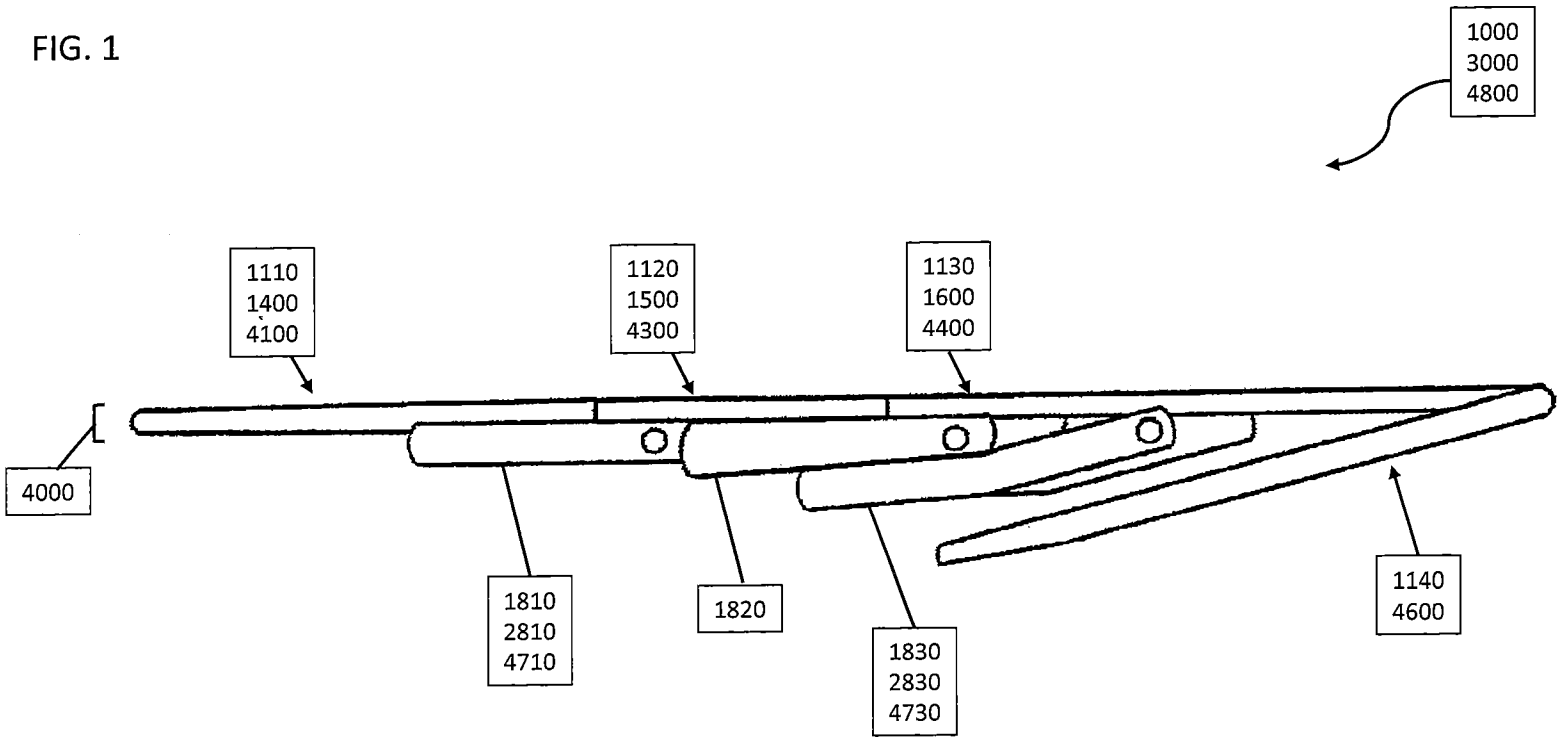
FIG. 1: A side view of the apparatus in the cot configuration prior to deployment of any inflatable member.
Figure 2:
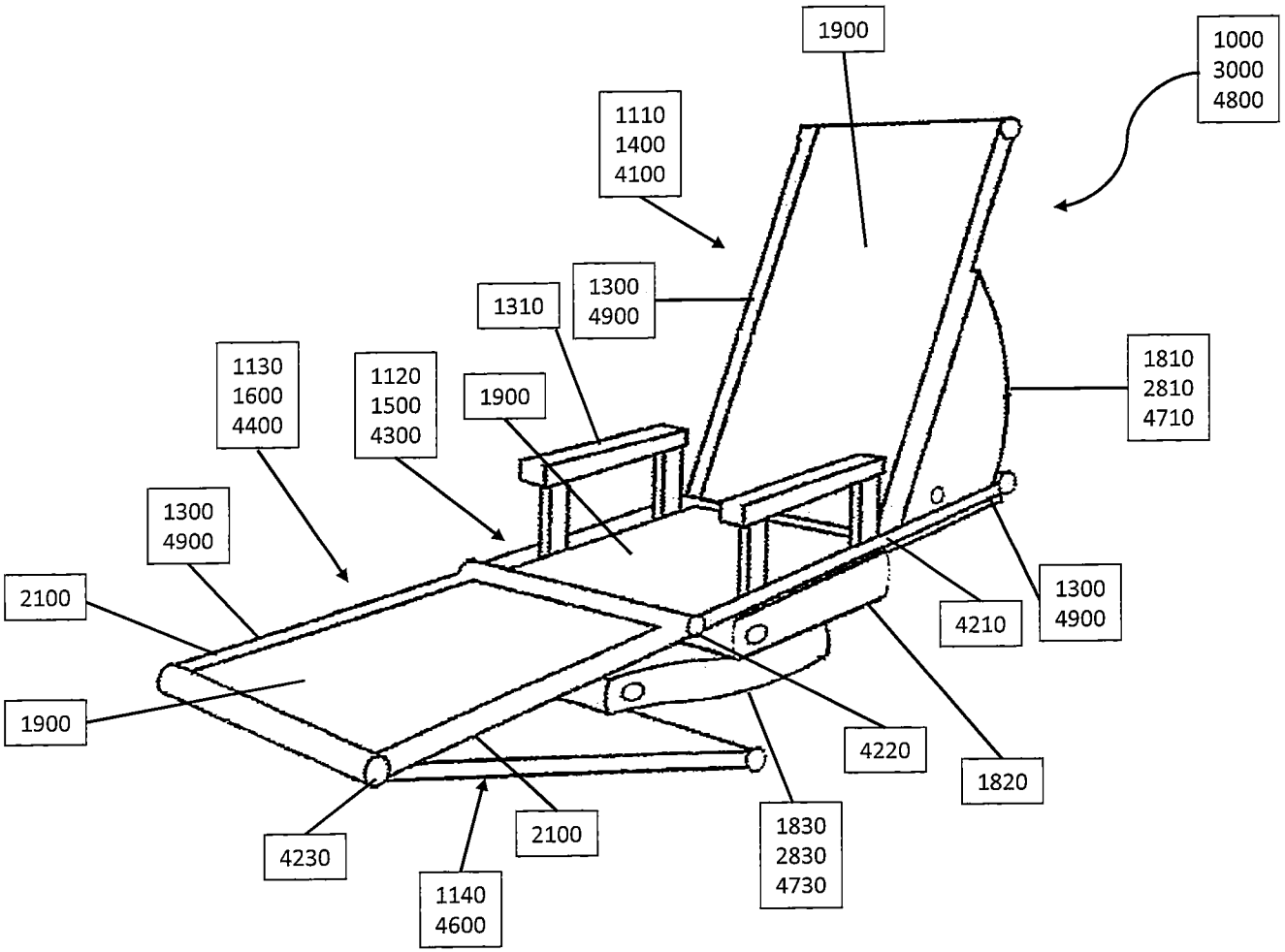
FIG. 2: An isometric view of the apparatus in FIG. 1 after deployment of the first inflatable member.
Figure 3:
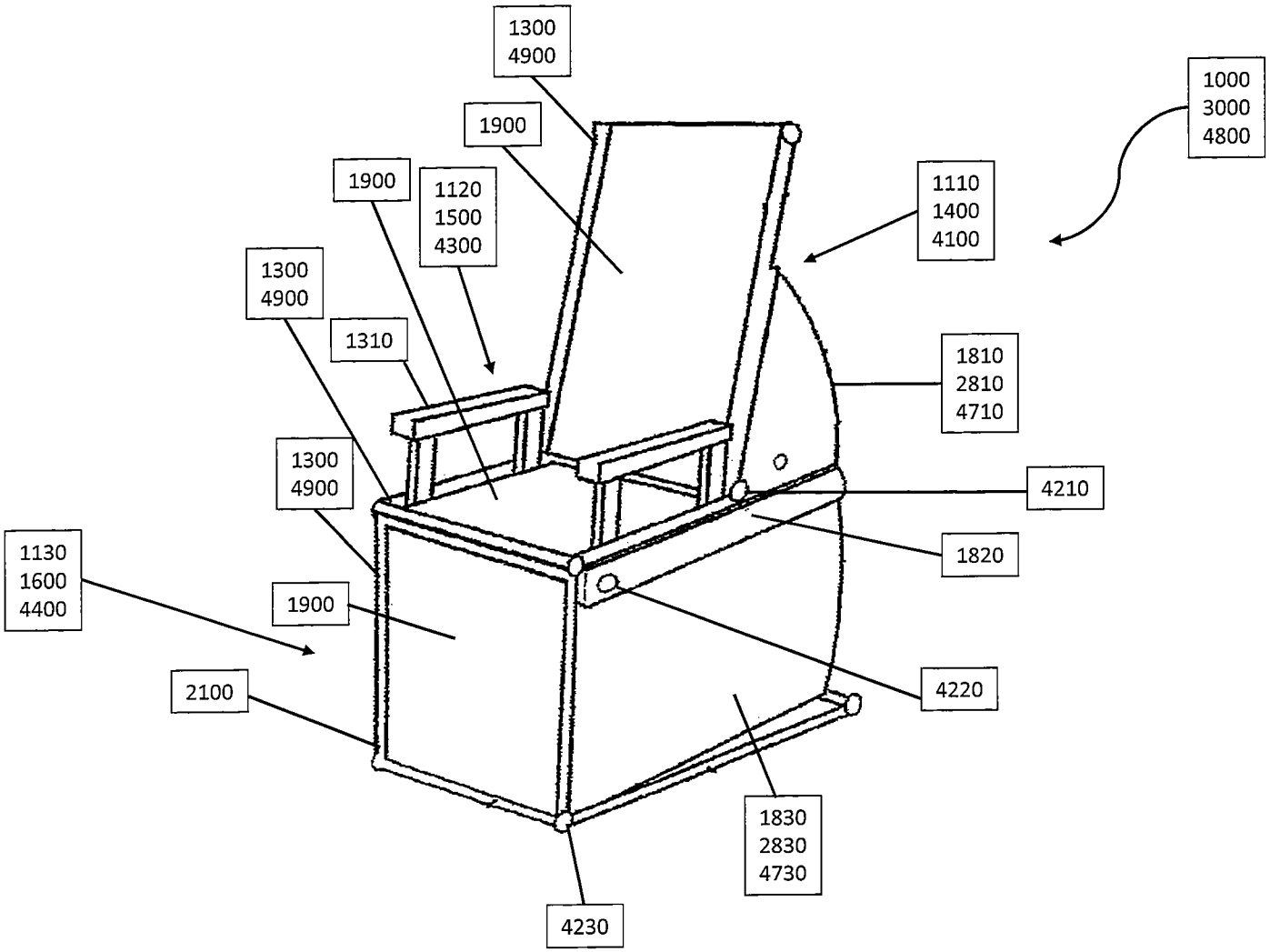
FIG. 3: An isometric view of the apparatus in FIG. 1 after deployment of the second inflatable member.
Figure 4:
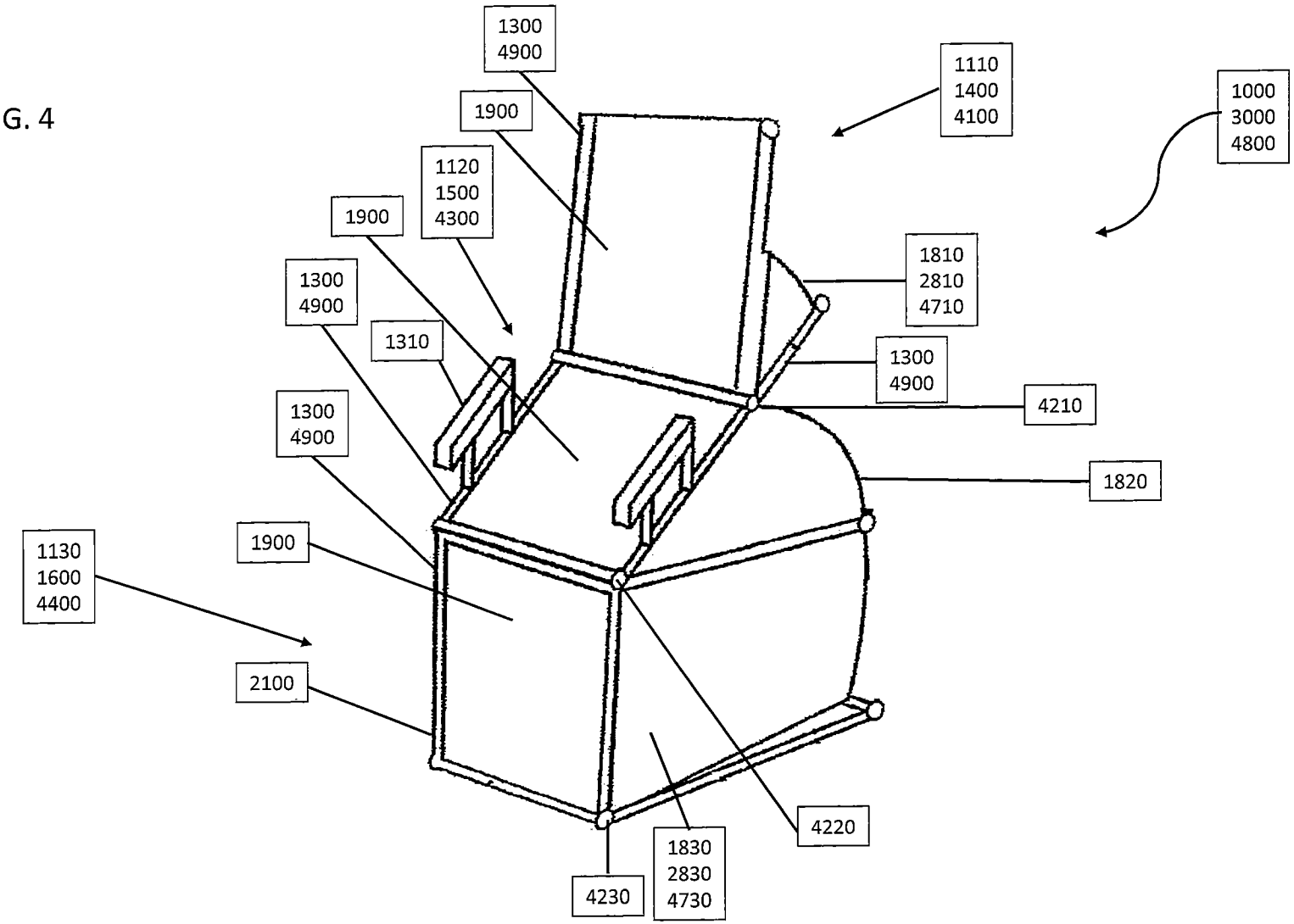
FIG. 4: An isometric view of the apparatus in FIG. 1 after deployment of the third inflatable member.

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments.

The terminology used herein is for the purpose of describing particular embodiments only and is not intended to be limiting. As used herein, the singular forms "a", "an" and "the" are intended to include the plural forms as well, unless the context clearly indicates otherwise.

Spatially relative terms, such as "under", "below", "lower", "over", "upper" and the like, may be used herein for ease of description to describe one element or feature's relationship to another when the apparatus is right side up.

The terms "first" and "second" are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

With reference to the use of the words "comprise" or "comprises" or "comprising" in the foregoing description and/or in the following claims, unless the context requires otherwise, those words are used on the basis and clear understanding that they are to be interpreted inclusively, rather than exclusively, and that each of those words is to be so interpreted in construing the foregoing description and the following claims.

The term "consisting essentially of" means that, in addition to the recited elements, what is claimed may also contain other elements (steps, structures, ingredients, components, etc.) that do not adversely affect the operability of what is claimed for its intended purpose as stated in this disclosure. Importantly, this term excludes such other elements that adversely affect the operability of what is claimed for its intended purpose as stated in this disclosure, even if such other elements might enhance the operability of what is claimed for some other purpose.

The terms "about" and "approximately" shall generally mean an acceptable degree of error or variation for the quantity measured given the nature or precision of the measurements. Typical, exemplary degrees of error or variation are within 20 percent (%), preferably within 10%, and more preferably within 5% of a given value or range of values. Numerical quantities given herein are approximate unless stated otherwise, meaning that the term "about" or "approximately" can be inferred when not expressly stated.

B. Rescue Chair

A rescue char is provided. The chair allows supine persons to self-rescue merely by lying supine on the flattened (horizontal or cot-configured) apparatus. Inflatable members then sequentially raise the patient from a supine position to an upright reclining position (the position one assumes in a chaise lounge chair), and then raise the patient into an upright sitting position. In some embodiments of the rescue chair the patient's seat is then raised such that the patient is in a partially standing position. In some embodiments of the chair the patient's back and seat are raised simultaneously, instead of sequentially. This has the advantage of rapidly raising the patient into the sitting position. The sequential approach has the advantage of superior stability during the rescue process.

The portable lifting apparatus allows a patient to be lifted from a supine position to a sitting position. The supine position refers to a position in which the patient is resting on his or her dorsal surface (i.e., the back and buttocks). The apparatus can function to lift a prone patient. A prone patient will be lifted into a kneeling position, from which is it not as easy to recover as a sitting or upright position. However, it may be easier under some circumstances for a fallen person to assume a prone position than a supine position.

The rigid, locking frame provides superior strength and stability. Whereas the use of air bladders alone would potentially leave some patients with too little stability to raise themselves from the sitting to standing position, the use of a frame does not have this limitation. In addition, air bladders alone are not sufficiently rigid to allow another person or persons to lift and carry the apparatus with the patient on it. In contrast, the frame is made of a high-strength material such as steel, aluminum, structural plastic, or composite. Although the frame is made to allow the sections to swivel relative to one another during deployment of the apparatus, the parts of the frame are configured to lock once the apparatus is deployed.

1. First Aspect

A first aspect of the invention is a portable lifting apparatus 1000 wherein a patient may be lifted from a supine position to a sitting position, comprising: a cot 4000, a plurality of inflatable airbags, and a rigid, foldable, locking frame 1300; the cot 4000 having a back section 4100, seat section 4300, lower section 4400, and base 1140, to be placed under the patient in the supine position; wherein the plurality of inflatable airbags are located in the following locations: underneath the back section above the frame extending from the seat section, between the base and the frame extending from a pivot location connecting the seat section and the lower section; and wherein the frame provides additional support for the patient.

The cot 4000 is a generally flat horizontal structure to accommodate a supine person. The cot 4000 is sectional, having a back section 4100, seat section 4300, and lower section 4400. The back section 4100 supports the patient's torso, and functions as the back-supporting portion of a chair after deployment. The seat section 4300 supports the buttocks and thighs of the patient, and functions as a seat of a chair after deployment. The lower section 4400 supports the lower parts of the patient's legs, and supports the apparatus after deployment. It may provide support to the legs after deployment, similar to the built-in hassock on a recliner. The base 1140 serves to contact the ground and support the rest of the apparatus once deployed. In some embodiments of the apparatus the base 1140 is folded under the lower section prior to deployment. Each of the sections swivels relative to the adjacent section, but will lock in position after deployment to allow strong and stable support for the patient.

The inflatable airbags are not inflated (or not fully inflated) prior to deployment of the apparatus. They function to raise the various sections of the apparatus during deployment. The airbags may be made from any suitable materials. In order to be suitable, the airbag material must resist the pressure of the patient's weight while fully inflated without rupturing. The airbag material must also resist the internal pressure of the inflation fluid without rupturing. The airbags may be inflated by several suitable means, such as a pneumatic pump (manual or powered), a compressed air container, or a reagent packet that generates gas when activated. The term "airbag" should not be construed to limit these structures to containing "air" (ambient atmospheric gas), but can contain any gas or potentially other fluids.

The rigid, foldable, locking frame 1300 provides superior strength and stability. Whereas the use of airbags alone would potentially leave some patients with too little stability to raise themselves from the sitting to standing position, the use of a frame does not have this limitation. In addition, airbags alone are not sufficiently rigid to allow another person or persons to lift and carry the apparatus 1000 with the patient on it. In contrast, the frame 1300 is made of a high-strength material such as steel, aluminum, structural plastic, or composite. Although the frame 1300 is made to allow the sections to swivel relative to one another during deployment of the apparatus 1000, the parts of the frame 1300 are configured to lock once the apparatus 1000 is deployed. For example, once the seat section is raised to a level adequate to support the patient's back above at least 45°, the frame 1300 will lock the back section 4100. Once the seat section 4300 and lower section 4400 are approximately perpendicular to one another (that is to say, the seat has been raised to place the patient in a sitting position), the frame 1300 locks the relative positions of these sections. The frame 1300 has the additional advantage that it assists in deflating each of the group of inflatable airbags upon completion of use.

In some embodiments of the apparatus 1000, the group of inflatable airbags are located in the following locations: underneath the back section 4100 and above the frame 1300 extending from the seat section 4300, and between the base 1140 and the frame 1300 extending from a pivot location connecting the seat section 43000 and the lower section 4400.

In some embodiments, the frame 1300 may include collapsible armrests 1310, affixed to the seat section 4300 of the apparatus which can be locked into place for use by the patient. The armrests 1310 can be raised and locked to provide the patient handholds. The armrests 1310 may be collapsed while the apparatus 1000 is flat, to save space or make it easier for a fallen patient to roll onto the apparatus 1000.

2. Second Aspect

A second aspect of the invention is an apparatus 4800 for raising a supine bipedal user into a sitting position, the apparatus 4800 capable of assuming a horizontal cot configuration and an upright chair configuration, the apparatus 4800 comprising: (a) a seatback 1400 that is substantially horizontal in the horizontal cot configuration; (b) a seat 1500 adjacent to the seatback 1400 that is substantially horizontal in the horizontal cot configuration; (c) a hassock 1600 adjacent to the seat 1500 that is substantially horizontal in the horizontal cot configuration; (d) a base 1140 adjacent to the hassock 1600 that is folded under the hassock 1600 in the horizontal cot configuration; (e) a rigid load-bearing frame 1300 that supports the seatback 1400, the seat 1500, the hassock 1600, and the base 1140, and comprising a plurality of locking joints 4210, 4220, and 4230 positioned to allow the seatback 1400, the seat 1500, the hassock 1600, and the base 1140 to swivel relative to one another; (f) a first inflatable body 1810 positioned to swivel the seatback at least 45° relative to the seat when at least partially inflated; and (g) a second inflatable body 1830 positioned to raise the seat 1500 to an elevation sufficient to cause the hassock 1600 to swivel about 90° relative to the seat 1500 when inflated; wherein the frame 1300 locks to arrest the swivel of the seatback 1400 relative to the seat 1500 when the seatback 1400 reaches a first locking angle relative to the seat 1500; the frame 1300 locks to arrest the swivel of the hassock 1600 relative to the seat 1500 when the hassock 1600 reaches a second locking angle relative to the seat 1500; and the frame 1300 locks to arrest the swivel of the base 1140 relative to the hassock 1600 when the base 1140 reaches a third locking angle relative to the hassock 1600.

It is contemplated that the apparatus 4800 is substantially horizontal in the cot configuration. In some embodiments, the seatback 1400 and the seat 1500 are substantially parallel in the horizontal cot configuration. In some embodiments, the hassock 1600, the seatback, and the seat 1500 are substantially parallel in the horizontal cot configuration.

The frame 1300 locks to arrest the swivel of the seatback 1400 relative to the seat 1500 when the seatback 1400 reaches a first locking angle relative to the seat. Thus when raised by the first inflatable body 1810, the seatback 1400 swivels through an arc until it reaches the first locking angle, at which point the frame 1300 locks the seat 1500 and seatback 1400 from swiveling any further. This creates a stable frame 1300 to support the user's back in the upright position. In some embodiments, the frame 1300 locks to prevent the relative angle of the seat 1500 and seatback 1400 from decreasing, but the frame 1300 is not locked against further increases in the same angle.

Similarly, the frame 1300 locks to arrest the swivel of the hassock 1600 relative to the seat 1500 when the hassock 1600 reaches a second locking angle relative to the seat 1500. The hassock 1600 is a section that supports the user's legs, like a hassock on a recliner. In a similar vein, the frame 1300 locks to arrest the swivel of the base 1140 relative to the hassock 1600 when the base 1140 reaches a third locking angle relative to the hassock 1600.

The apparatus 4800 may be designed to set the first locking angle at any angle of at least about 45°. For example, suitable angles include 50°, 55°, 60°, 65°, 70°, 75°, 80°, 85°, 90° at least any of the foregoing, and any range between any two of the foregoing. In a specific embodiment, the first locking angle is about 80°. A first locking angle of about 80° has the advantage of raising the user into a position in which the user's back is nearly completely upright, but still slightly reclined to prevent the user from pitching forward if the user is not yet prepared to stand.

The apparatus 4800 may be designed to set the second locking angle at a suitable angle to allow the user's body to be raised from the floor enough the facilitate assuming a standing position. The second locking angle may be for example 45-90°. In a specific embodiment (such as the one shown in the figures), the second locking angle is about 90°.

The apparatus 4800 may be designed to set the third locking angle at a suitable angle to lock the base 1140 in place relative to the hassock 1600. The base 1140 should be positioned more or less under the user's center of mass, unless the base 1140 itself has a significant mass to offset it. In some embodiments, the third locking angle is about 90°.

In some embodiments, the seatback 1400 and the seat 1500 may include a portion of the rigid load-bearing frame 1300 and a load-bearing fabric 1900. For example, the frame 1300 may form the periphery of the seat 1500 and the seatback 1400, and the fabric 1900 may be fastened to the frame 1300 and extend across the seat 1500 and seatback 1400 to support the user. Such a configuration has the advantage of providing the strength and rigidity of the frame 1300, while using lighter weight flexible fabric 1900 to support the user. Flexible fabric 1900 also provides more comfort to the user than would a seat 1500 or seatback 1400 made of a rigid material. In some embodiments of the apparatus 4800, the hassock 1600 may also include a portion of the rigid load-bearing frame 1300 and/or the fabric 1900.

In further embodiments, the seatback may include two parallel rigid load-bearing poles oriented generally longitudinally and/or a load-bearing fabric 1900 stretching between the two parallel rigid load-bearing poles positioned to contact the user's back. Similarly, the seat may include two parallel rigid load-bearing poles oriented generally longitudinally and/or a load-bearing fabric 1900 stretching between the two parallel rigid load-bearing poles positioned to contact the user's buttocks.

During deployment, the inflatable bodies 1810, 1820, 1830 may temporarily support the user until the frame locks. For example, in some embodiments, the second inflatable 1830 body supports the user until the third locking angle is reached. In some such embodiments, the frame 1300 supports the user once the third locking angle is reached.

Another inflatable body 1820 may be included under the seat 1500 to lift the user's rear such that the user is in a bent-leg standing position while still supported by the apparatus 4800. In some embodiments, the apparatus 4800 may include a third inflatable body 1820 positioned to swivel the seat 1500 at least 45° relative to the hassock 1600 while in the upright chair configuration. That is to say, the relative angle of the hassock 1600 and seat 1500 actually increases when the third inflatable body 1820 inflates. In some such embodiments, the frame 1300 locks to arrest the swivel of the seat 1500 relative to the hassock 1600 when the seat 1500 reaches a fourth locking angle relative to the hassock 1600. Ideally, the fourth locking angle is about 20°.

In some embodiments, the frame 1300 is composed of steel, aluminum, or titanium.

In some embodiments, the apparatus 4800 may include a third inflatable body 1830 positioned to swivel the seat 1500 at least 45° relative to the hassock 1600 while in the upright chair configuration may include an inflator connected to provide gas to at least one of the first inflatable body 1810, the second inflatable body 1830 and the third inflatable body 1820, the inflator selected from the group consisting of: a container of compressed gas, a pneumatic pump, and a reagent composition that produces gas when reacted.

In some embodiments, the apparatus 4800 may include a pair of load-bearing armrests 1310. The armrests 1310 may be positioned to bear a load equal to the weight of the user when in the deployed position. The armrests 1310 have the advantage of providing handholds and extra support for the user if the user lifts himself or herself with his or her arms. In some such embodiments, the pair of load-bearing armrests 1310 has a retracted position and a deployed position. Load-bearing armrests 1310 with a retracted position and a deployed position have the advantages of ease of storage, and ease of mounting as the user can roll on to the apparatus 4800 from the side while the armrests 1310 are retracted.

3. Third Aspect

A third aspect of the invention is a folding inflatable rescue chair comprising: (a) a seatback 1400; (b) a seat 1500; (c) two front legs 2100; (d) a base 1140; (e) a load-bearing frame 1300 that is jointed to allow the seatback 1400, the seat 1500, the two front legs 2100, and the base 1140 to swivel relative to one another; (f) a first inflatable airbag 2810 positioned to swivel the seatback 1400 at least 45° relative to the seat 1500 when at least partially inflated; and (g) a second inflatable airbag 2830 positioned to raise the seat 1500 to an elevation sufficient to cause the two front legs 2100 to swivel about 90° relative to the seat 1500 when inflated; wherein the frame 1300 locks to arrest the swivel of the seatback 1400 relative to the seat 1500 when the seatback 1400 reaches a first angle of at least 45° relative to the seat 1500; the frame 1300 locks to arrest the swivel of the two front legs 2100 relative to the seat 1500 when the two front legs 2100 reach a second angle of about 90° relative to the seat 1500; and the frame 1300 locks to arrest the swivel of the base 1140 relative to the two front legs 2100 when the base 1140 reaches an angle of about 90° relative to the two front legs 2100.

In this aspect, the two front legs 2100 serve to support the rest of the chair when fully deployed (akin to the lower section and the hassock of the first and second embodiments, respectively). The base 1140, the frame 1300, and the airbags 2810, 2830 serve the same functions described above.

4. Fourth Aspect

A fourth aspect of the invention is a rescue cot 3000 to raise a supine user into a sitting position without assistance, the rescue cot 3000 comprising: (a) a load-bearing cot frame 4900; (b) a back-supporting section 1110; (c) a buttocks-supporting section 1120; (d) a first frame joint 4210 positioned to allow the back-supporting section 1110 to swivel relative to the buttocks-supporting section 1120, and configured to lock when the back-supporting section 1110 is inclined by at least a first locking angle relative to the buttocks-supporting section 1120; (e) a leg-supporting section 1130; (f) a second frame joint 4220 positioned to allow the leg-supporting section 1130 to swivel relative to the buttocks-supporting section 1120, and configured to lock when the leg-supporting section 1130 is inclined by a second locking angle relative to the buttocks-supporting section 1120; (g) a base section 4600 adjacent to and folded under the leg-supporting section 1130; (h) a third frame joint 4230 positioned to allow the base 4600 section to swivel relative to the leg-supporting section 1130, and configured to lock when the leg-supporting section 1130 is inclined by a third locking angle relative to the base section 4600; (i) a first inflatable member under the back-supporting section 4710, positioned to raise the back-supporting section 1110 by at least 45° when inflated; and (j) a second inflatable member 4730 under the buttocks-supporting section 1120, positioned to elevate the buttocks-supporting section 1120 while maintaining it level.

In this aspect, the load-bearing cot frame 4900 supports the weight of the apparatus and patient, similar to the load-bearing frames described in the aforementioned aspects. The first frame joint 4210 locks to arrest the rotation of the back-supporting section 1110 relative to the buttocks-supporting section 4300 when the back-supporting section 1110 reaches a first locking angle relative to the buttocks-supporting section 1120. Thus when raised by the first inflatable member 4710, the back-supporting section 1110 travels along a path rotating the torso of the user forward until it reaches the first locking angle, at which point the frame locks the back-supporting section 1110 and buttocks-supporting section 1120 from rotating any further. This creates a stable frame to support the user's back in the upright position.

Similarly, the second frame joint 4220 locks to arrest the rotation of the leg-supporting section 1130 relative to the buttocks-supporting section 1120 when the leg-supporting section 1130 reaches a second locking angle relative to the buttocks-supporting section 1120, initiated by the inflation of the second inflatable member 4730. During this phase, the support of the patient's lower legs is shifted away from the leg-supporting section 1130 to place the patient in a position to walk away.

Finally, the third frame joint 4230 locks to arrest the rotation the base section 4600 to relative to the leg-supporting section 1130 once the base section 4600 reaches the third locking angle relative to the leg-supporting section 1130. Once the third frame joint 4230 is locked, the base section 4600 is responsible for assisting the inflatable members 4710, 4730 in the stability of the apparatus.

The inflatable members 4710, 4730 serve a purpose akin to the inflatable bodies and airbags described in the aforementioned aspects. The base section 4600 serves the same function as the base described in the aforementioned aspects.

Prophetic Example

The preferred embodiment of the disclosed device is comprised of a three rectangular sections, adjacent to one another that form the "cot" portion of the apparatus. The rectangular sections each have a separate and unique function in operation of the apparatus. The apparatus is stored in the "cot" configuration which orients the three rectangular sections to form a flat surface, parallel to the floor to place the patient's body. In addition to the three sections located in the cot portion of the apparatus is a fourth rectangular section called the base. These four sections are supported by a rigid, steel frame. Finally, the apparatus contains three inflatable members used to orient the apparatus in a chaise lounge position, followed by an upright sitting position, and if necessary, an upright, forward tilting position. Each position represents the completion of each stage.

The first section, or "seatback", is substantially horizontal in the cot configuration. The seatback is comprised of two steel, rigid, load-bearing poles oriented generally longitudinally and a load-bearing fabric stretching between the two parallel rigid load-bearing poles position to contact the user's back. The seatback supports the user's torso while in the cot configuration, and throughout the process, serving as a traditional "chair back" once the first stage is completed, and throughout the remainder of the operation. The seatback is connected to the adjacent seat section by way of a joint that allows the seatback to rotate or swivel relative to the seat.

The second section, or "seat" is adjacent to the seatback and is substantially horizontal in the cot configuration. Similar to the seatback, the seat includes two parallel steel, rigid load-bearing poles oriented generally longitudinally and a load-bearing fabric stretching between the two parallel rigid load-bearing poles positioned to contact the user's buttocks and thighs. The seat supports the user's buttocks throughout the process and serves as a traditional "seat" once the first stage is completed, and throughout the remainder of the process. Located on the seat are two collapsible armrest that are to be used at the patient's discretion for support when exiting the apparatus, or during the inflation of each respective member.

The third section, or "hassock" is adjacent to the seatback and is substantially horizontal in the cot configuration. The hassock serves as support for the legs while in the cot configuration. Once the second stage is complete, the hassock no longer supports the user's lower legs. At that time, the rigid, steel frame assists in supported the apparatus, along with the base. Similar to the seatback, the hassock is connected to the adjacent seat section by way of a joint that allows the hassock to rotate or swivel relative to the seat.

Adjacent to the hassock is a fourth rectangular section, folded under the hassock in the cot configuration called the base. The base is connected to the hassock by way of a joint that allows the base to swivel or rotate relative the hassock and serve as support for the apparatus once the second stage is complete.

The first inflatable member is positioned behind the seatback so as to rotate the seatback toward the user, and to the chaise lounge position. This is accomplished by manually filling the inflatable member with air so that the seatback reaches an angle of approximately 80°. The pressure from the inflatable member prevents the seatback from reverting to the default cot configuration, prior the seatback achieving the locking angle of 80°. Once the seatback reaches the 80° angle, the frame joint locks, preventing the backward rotation of the seatback to the default cot configuration and completing the first stage of the process. At this time, the user will remove the air supply.

The second inflatable member is position under the seat so as to rotate the hassock relative to the seat and the base relative to the hassock. Similar to the first inflatable member, this is accomplished by filling the inflatable member with air until the hassock reaches an angle of approximately 90° relative to the seat and the base reaches an angle of approximately 90° relative to the hassock. The pressure from the inflatable member assists in preventing the seat and hassock from collapsing back to the default cot position before the angle is reached. Once the angle of 90° is reached, the second frame joint locks, preventing the backward rotation of the hassock relative to the seat to the default cot configuration. Almost simultaneously, the third frame joint locks, terminating the rotation of the base in any direction relative to the hassock, completing the second stage of the process. The air supply is removed and the patient is free to walk away on his or her own accord.

A third inflatable member, located between the seat and the second inflatable member, is position so as to rotate the seat forward relative to the hassock in the event the user is unable to walk away at this time, a third stage is initiated. Similar to the previously described inflatable members, the third inflatable member is filled with air until the seat reaches an angle of approximately 60°. The pressure from the inflatable member temporarily supports the weight of the patient prior to reaching the second locking angle. Once the angle is of 60° is reached, the second frame joint locks, terminating the rotation of the seat. Unlike the previously described frame joints, this frame joint prohibits the apparatus from achieving an angle greater than 60°, as well as preventing the apparatus from reverting to the previous stage in the event that the inflatable member is unable to withstand the weight of the patient. The previously described frame joints do not prevent the device from achieving an angle greater than the described locking angle, but are primarily locked to prevent the device from collapsing to the default cot configuration in the event the inflatable members cannot withstand the weight of the patient, or are overinflated to the point of rupture. Once the frame joint locks, the air supply is removed and the patient is free to walk away under his or her own accord.

Once the patient has exited the apparatus, the air is removed from the inflatable members for re-use. The rigid steel frame assists in the deflation of the inflatable members so the apparatus is available for rapid repeated use,

C. Conclusions

It is to be understood that any given elements of the disclosed embodiments of the invention may be embodied in a single structure, a single step, a single substance, or the like. Similarly, a given element of the disclosed embodiment may be embodied in multiple structures, steps, substances, or the like.

The foregoing description illustrates and describes the processes, machines, manufactures, compositions of matter, and other teachings of the present disclosure. Additionally, the disclosure shows and describes only certain embodiments of the processes, machines, manufactures, compositions of matter, and other teachings disclosed, but, as mentioned above, it is to be understood that the teachings of the present disclosure are capable of use in various other combinations, modifications, and environments and is capable of changes or modifications within the scope of the teachings as expressed herein, commensurate with the skill and/or knowledge of a person having ordinary skill in the relevant art. The embodiments described hereinabove are further intended to explain certain best modes known of practicing the processes, machines, manufactures, compositions of matter, and other teachings of the present disclosure and to enable others skilled in the art to utilize the teachings of the present disclosure in such, or other, embodiments and with the various modifications required by the particular applications or uses. Accordingly, the processes, machines, manufactures, compositions of matter, and other teachings of the present disclosure are not intended to limit the exact embodiments and examples disclosed herein. Any section headings herein are provided only for consistency with the suggestions of 37 C.F.R. §1.77 or otherwise to provide organizational queues. These headings shall not limit or characterize the invention(s) set forth herein.

I claim:

1. A portable lifting apparatus wherein a patient may be lifted from a supine position to a sitting position, comprising: a cot, a plurality of inflatable airbags, and a rigid, foldable, locking frame;

the cot having a back section, seat section, lower section, and base, to be placed under the patient in the supine position;

wherein the plurality of inflatable airbags are located in the following locations: underneath the back section and above the frame that extends from the seat section, and between the base and the frame extending from a pivot location connecting the seat section and the lower section;

wherein the base is configured to contact the ground and support the rest of the apparatus once deployed; and wherein the frame provides additional support for the patient.

2. The apparatus of claim 1, wherein the frame includes collapsible armrests, affixed to the seat section of the apparatus which can be locked into place for use by the patient.

3. The apparatus of claim 1, wherein the frame assists in deflating each of the plurality of inflatable airbags upon completion of use by compressing the inflatable bodies when returned to the pre-deployment position.

4. An apparatus for raising a supine bipedal user into a sitting position, the apparatus capable of assuming a horizontal cot configuration and an upright chair configuration, the apparatus comprising:

(a) a seatback that is substantially horizontal in the horizontal cot configuration;

(b) a seat adjacent to the seatback that is substantially horizontal in the horizontal cot configuration;

(c) a hassock adjacent to the seat that is substantially horizontal in the horizontal cot configuration;

(d) a base adjacent to the hassock that is folded under the hassock in the horizontal cot configuration;

(e) a rigid load-bearing frame that supports the seatback, the seat, the hassock, and the base, and comprising a plurality of locking joints positioned to allow the seatback, the seat, the hassock, and the base to swivel relative to one another;

(f) a first inflatable body positioned to swivel the seatback at least 45° relative to the seat when at least partially inflated; and (g) a second inflatable body positioned to raise the seat to an elevation sufficient to cause the hassock to swivel about 90° relative to the seat when inflated;

wherein the base contacts the ground and support the rest of the apparatus in the upright chair configuration;

wherein the frame locks to arrest the swivel of the seatback relative to the seat when the seatback reaches a first locking angle relative to the seat;

the frame locks to arrest the swivel of the hassock relative to the seat when the hassock reaches a second locking angle relative to the seat; and the frame locks to arrest the swivel of the base relative to the hassock when the base reaches a third locking angle relative to the hassock.

5. The apparatus of claim 4, wherein the first locking angle is about 80°.

6. The apparatus of claim 4, wherein the second locking angle is about 90°.

7. The apparatus of claim 4, wherein the third locking angle is about 90°.

8. The apparatus of claim 4, wherein the seatback and the seat comprise a portion of the rigid load-bearing frame and a load-bearing fabric.

9. The apparatus of claim 4, wherein the hassock comprises a portion of the rigid load-bearing frame and load-bearing fabric.

10. The apparatus of claim 4, wherein the second inflatable body supports the user until the third locking angle is reached.

11. The apparatus of claim 4, wherein the frame supports the user once the third locking angle is reached.

12. The apparatus of claim 4, comprising a third inflatable body positioned to swivel the seat at least 45° relative to the hassock while in the upright chair configuration.

13. The apparatus of claim 4, comprising a third inflatable body positioned to swivel the seat at least 45° relative to the hassock while in the upright chair configuration; and wherein the frame locks to arrest the swivel of the seat relative to the hassock when the seat reaches a fourth locking angle relative to the hassock.

14. The apparatus of claim 4, comprising a third inflatable body positioned to swivel the seat at least 45° relative to the hassock while in the upright chair configuration; wherein the frame locks to arrest the swivel of the seat relative to the hassock when the seat reaches a fourth locking angle relative to the hassock; and wherein the fourth locking angle is about 20°.

15. The apparatus of claim 4, comprising a third inflatable body positioned to swivel the seat at least 45° relative to the hassock while in the upright chair configuration; and comprising an inflator connected to provide gas to at least one of the first inflatable body, the second inflatable body and the third inflatable body, said inflator selected from the group consisting of: a container of compressed gas, a pneumatic pump, and a reagent composition that produces gas when reacted.

16. The apparatus of claim 4, comprising a pair of load-bearing armrests; and wherein the pair of load-bearing armrests has a retracted position and a deployed position, and wherein the pair of load-bearing armrests is positioned to bear a load equal to the weight of the user when in the deployed position.

17. The apparatus of claim 4, wherein the seatback and the seat are substantially parallel in the horizontal cot configuration.

18. The apparatus of claim 4, wherein the hassock, the seatback, and the seat are substantially parallel in the horizontal cot configuration.

19. A folding inflatable rescue chair comprising:

(a) a seatback;

(b) a seat;

(c) two front legs;

(d) a base;

(e) a load-bearing frame that is jointed to allow the seatback, the seat, the two front legs, and the base to swivel relative to one another;

(f) a first inflatable airbag positioned to swivel the seatback at least 45° relative to the seat when at least partially inflated; and (g) a second inflatable airbag positioned to raise the seat to an elevation sufficient to cause the two front legs to swivel about 90° relative to the seat when inflated;

wherein the base is positioned to contact the ground and support the rest of the apparatus once deployed;

wherein the frame locks to arrest the swivel of the seatback relative to the seat when the seatback reaches a first angle of at least 45° relative to the seat;

the frame locks to arrest the swivel of the two front legs relative to the seat when the two front legs reach a second angle of about 90° relative to the seat; and the frame locks to arrest the swivel of the base relative to the two front legs when the base reaches an angle of about 90° relative to the two front legs.

* * * * *